US005487518A

United States Patent [19]

McCraney et al.

[11] Patent Number: 5,487,518

[45] Date of Patent: Jan. 30, 1996

[54] WATER HEATER RESTRAINT

[76] Inventors: William E. McCraney, 22262 Kittery Cir., Huntington Beach, Calif. 92646; William J. McCraney, 1918 W. Chestnut St., Santa Ana, Calif. 92703

[21] Appl. No.: 191,271

[22] Filed: Feb. 3, 1994

[51] Int. Cl.[6] ..... A47K 1/08

[52] U.S. Cl. ..... 248/225.11; 248/313; 248/298.1

[58] Field of Search ..... 248/225.11, 313, 248/231, 154, 146, 201, 316.8, 223.4, 220.2, 231, 307; 52/36.4, 36.5, 721, 710

[56] References Cited

U.S. PATENT DOCUMENTS

| | | | |
|---|---|---|---|
| 2,937,766 | 5/1960 | Penn | 211/147 |
| 3,319,983 | 5/1967 | Zibell | 287/189.35 |
| 4,955,573 | 9/1990 | Horvath | 248/313 |
| 5,020,760 | 6/1991 | Mayr | 248/313 |
| 5,190,260 | 3/1993 | Daubenspeck | 248/313 |

FOREIGN PATENT DOCUMENTS

| | | | |
|---|---|---|---|
| 1087232 | 11/1953 | France | 248/231 |

*Primary Examiner*—Leslie A. Braun
*Assistant Examiner*—Anita M. King
*Attorney, Agent, or Firm*—Edgar W. Averill, Jr.

[57] ABSTRACT

A water heater restraint for securing a vertical cylindrical water heater adjacent a wall. The restraint has an elongated strut, which is held horizontally to a wall against which the water heater is to be restrained. A pair of triangular gussets may be slid along the elongated strut so that one gusset is on each side of the water heater. Strapping is attached to the two gussets and surrounds the water heater and the gussets are secured to the elongated strut. The strut is secured to the wall by channel clamps which may be secured to vertical studs and slide along the elongated strut so that the water heater can be secured independently of the position of the studs.

1 Claim, 4 Drawing Sheets

WATER HEATER RESTRAINT

BACKGROUND OF THE INVENTION

The field of the invention is brackets and the invention relates more particularly to brackets used to secure a water heater particularly against movement during an earthquake.

Water heaters have been secured to a wall in numerous ways. One bracket is shown in U.S. Pat. No. 4,955,573 where a strap or outer collar is bolted to a joint tie strap and a second support is used to hold the water heater away from the wall and is also secured to the joint tie strap. A bracket for holding a water heater in a corner is shown in U.S. Pat. No. 5,020,760. A pair of angle brackets is used to hold a water heater to a concrete floor in U.S. Pat. No. 5,131,133. A bracket for holding gas containers and similar tanks is shown in U.S. Pat. No. 3,765,635. A water heater restraint must secure attachment to the studs behind a wall board and, since most water heaters are already in place when such a device is used, it must be accurately positionable in the position in which it is located.

SUMMARY OF THE INVENTION

It is the object of the present invention to provide a water heater restraint which may be positionable at any location independent of the location of the studs, is easy to install and adaptable to different sizes of water heaters and capable of withstanding an earthquake.

The present invention is for a water heater restraint for securing a vertical, cylindrical water heater adjacent to a wall. The wall has a plurality of vertical studs and the restraint has an elongated strut which may be held to two studs in the wall in a horizontal position. A pair of triangular gussets is slidable along the elongated strut and a strap is attached to the gussets and surrounds the water heater and may be tightened against any size of water heater. Preferably the gussets have an angled, flat inner face which assist in holding the water heater.

DESCRIPTION OF THE PREFERRED EMBODIMENTS

Figure 1:
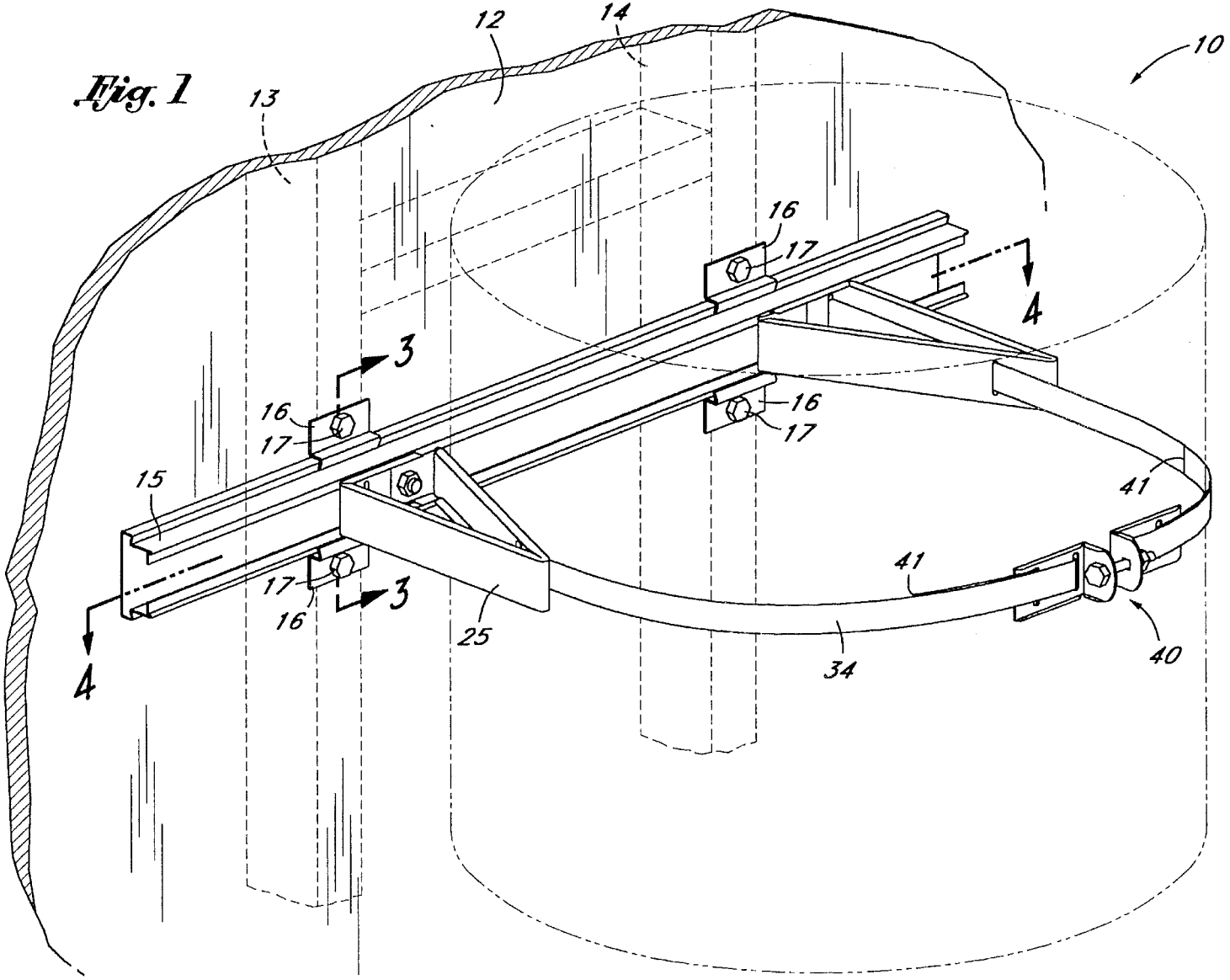
FIG. 1 is a perspective view of the water heater restraint of the present invention shown affixed to two vertical studs and surrounding a water heater shown in phantom view.

A water heater restraint system is shown in perspective view in FIG. 1 and indicated generally by reference character 10. The water heater 11 is shown in phantom view and is secured near but not touching wall 12, which, in turn, is secured to a pair of vertical studs—13 and 14.

Figure 3:
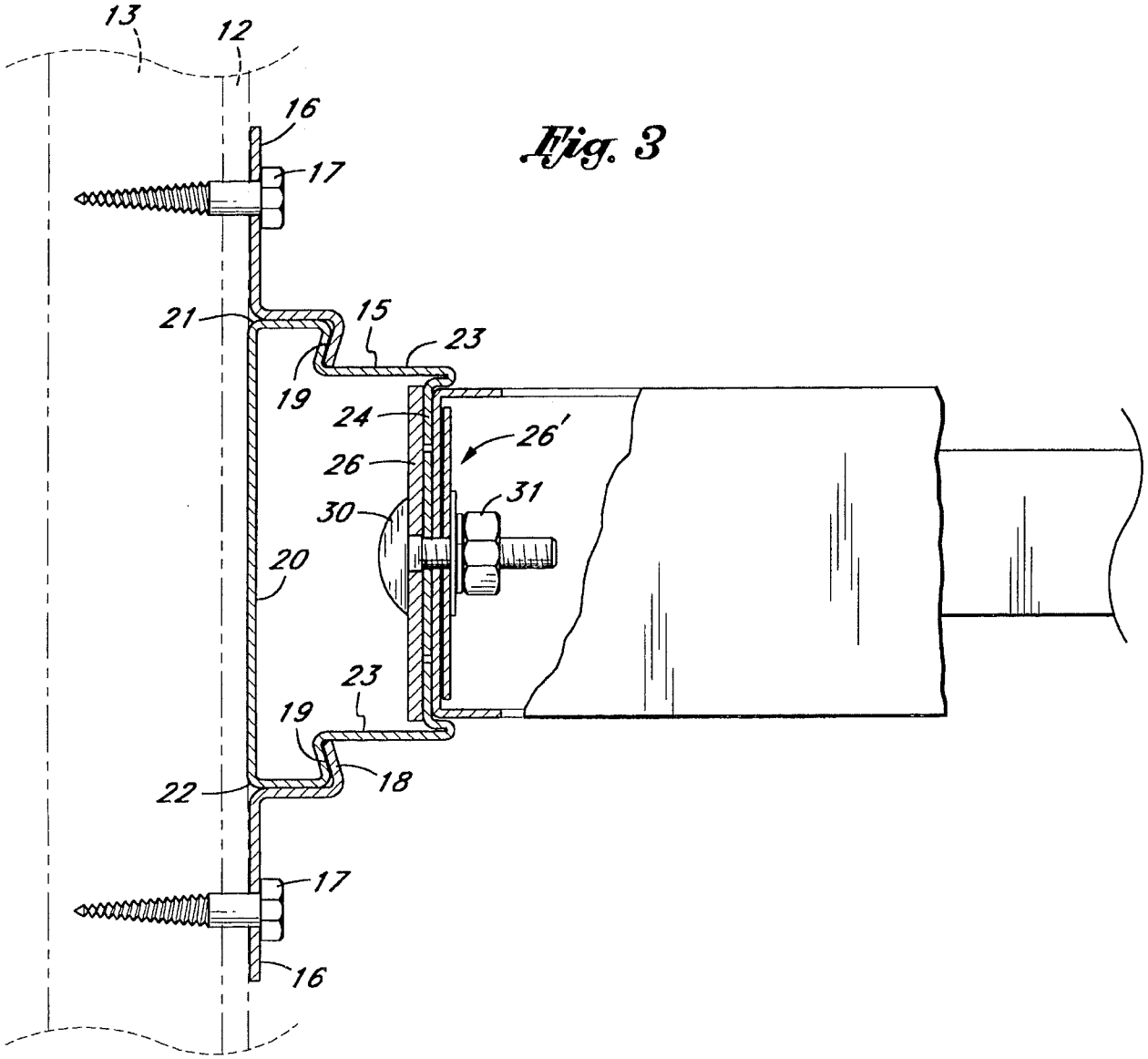
FIG. 3 is an enlarged cross-sectional view taken along lines 3—3 to FIG. 1.

Water heater restraint 10 may be positionable anywhere along the wall depending upon the position of the water heater and independent of the position of the wall studs. A bi-channel strut 15 is secured to wall 12 by two pairs of channel clamps 16, which are bolted by lag bolts 17 into studs 13 and 14. The detail of construction of the bi-channel strut 15 is shown best in FIG. 3 where channel clamps 16 can be seen to have an inwardly directed flange 18 which abuts a first channel 19 in bi-channel strut 15. Strut 15 has an elongated back portion 20, which has a top edge 21 and a bottom edge 22. Each of the first channels 19 extend from the top and bottom edges of back portion 20 and in turn lead to outwardly extending portions 23. Outwardly extending portions 23 support a second channel 24, which holds a pair of gussets in a manner described below.

Figure 2:
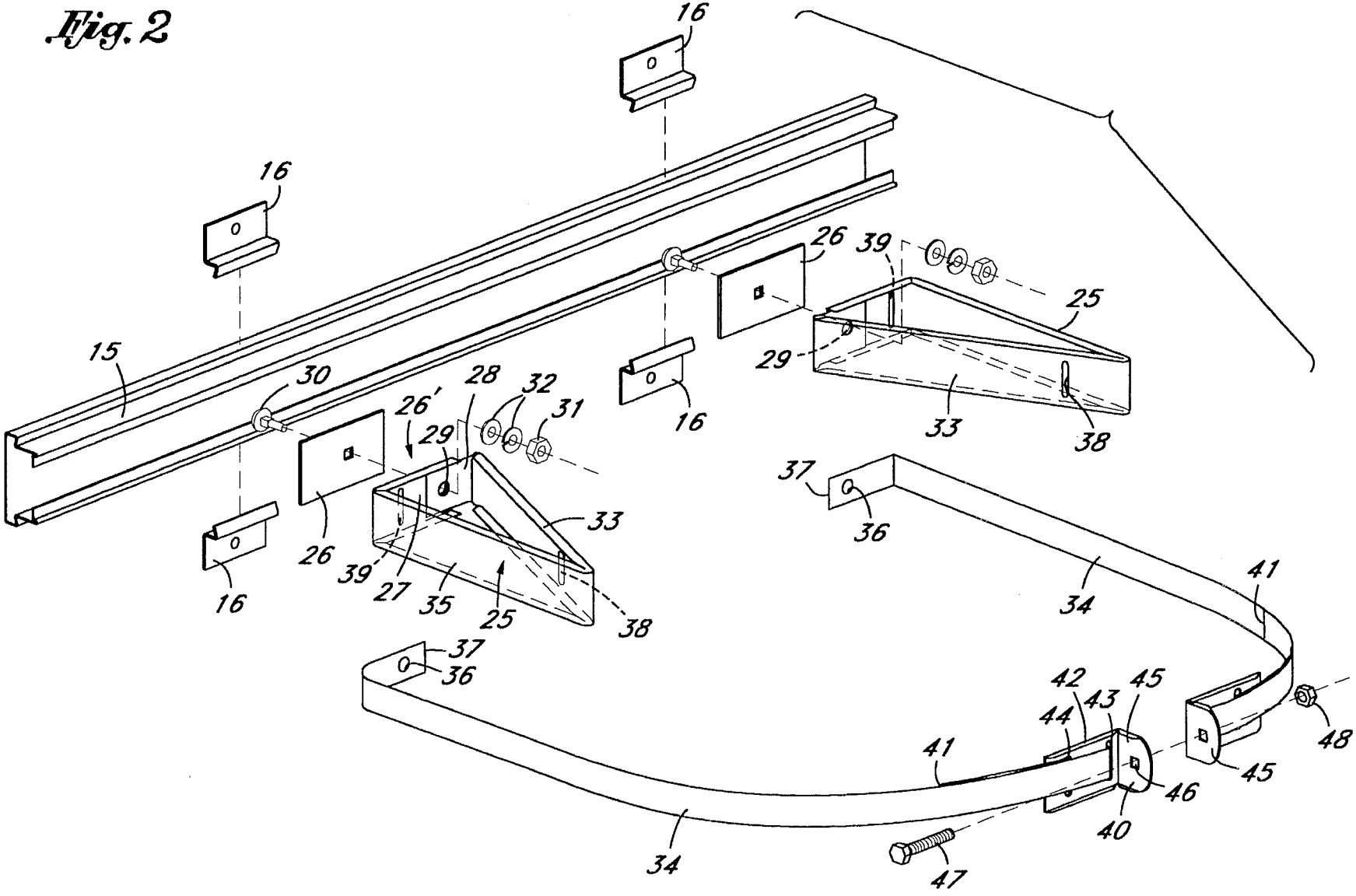
FIG. 2 is an exploded perspective view of the bracket of FIG. 1.
Figure 4:
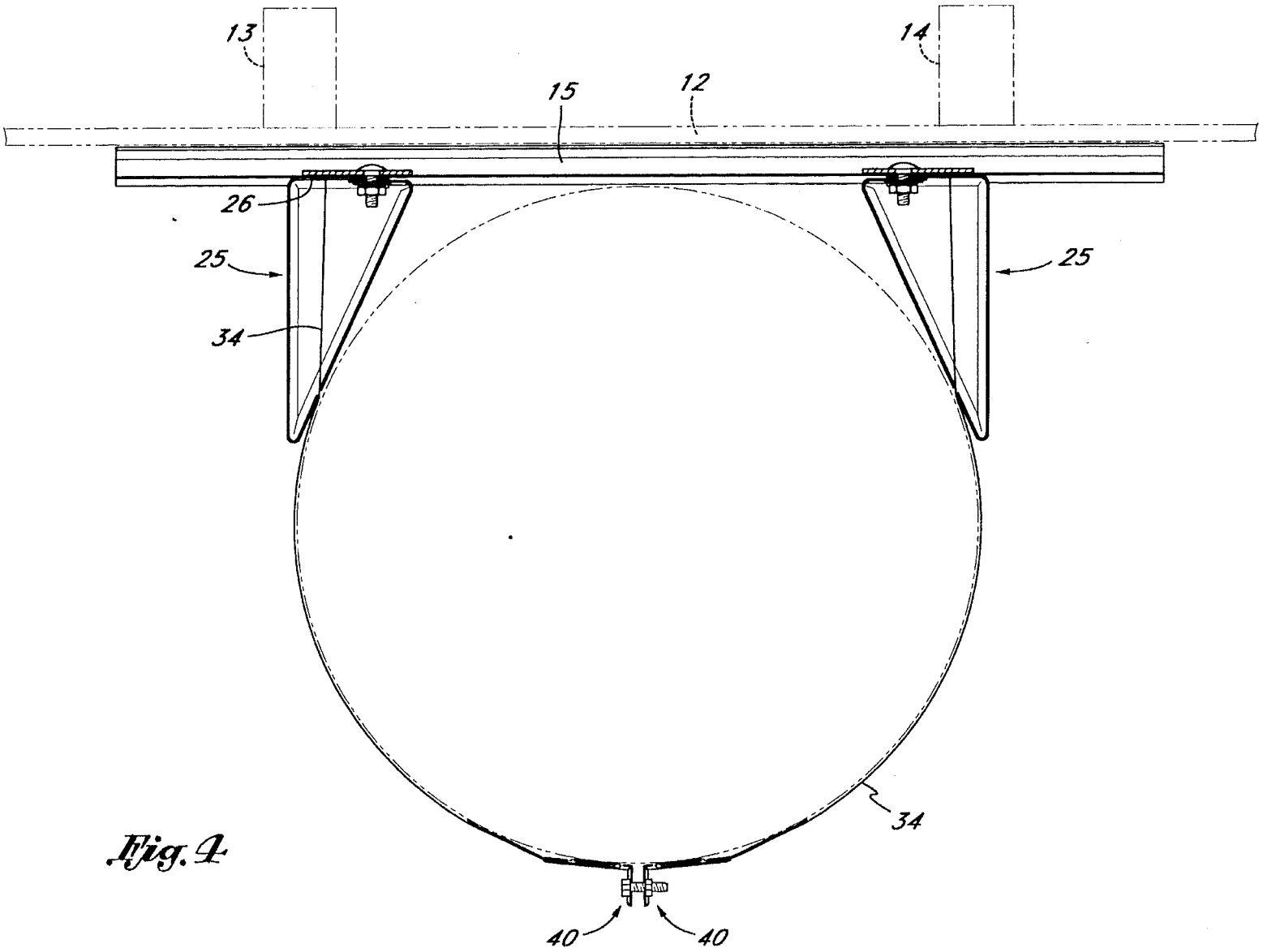
FIG. 4 is a cross-sectional view taken along line 4—4 of FIG. 1.

Turning now to FIG. 2, bi-channel strut 15 may be slid back and forth horizontally in channel clamp 16 so that channel clamp 16 can be securely held to vertical studs. Similarly, gussets 25 are slidingly held in bi-channel strut 15 by backer plates 26, which are placed behind second channel 24 as shown best in FIG. 3 of the drawings. Gusset 25 is generally in the shape of a right triangle (shown best in FIG. 4). Gusset 25 has a base 26, which actually has two separate portions 27 and 28 which overlap and each has a hole 29 therethrough through which a bolt 30 is secured by a nut 31 and appropriate washers 32. The angled edge of hypotenuse of the right triangle is indicated by reference character 33 and forms an angle face to support a water heater as shown best in FIG. 4 of the drawings. This securely prevents the water heater from moving sideways along the wall during an earthquake and yet there is a certain amount of give based upon the fabrication of gusset 25 from sheet metal and the positioning of strapping 34 around the heater. Gusset 25 has an outer side 35 for strength. The strapping 34 has a hole 36 formed near its inner end 37. Inner end 37 is passed through slot 38 in hypotenuse 33. This means, of course, gusset 25 need not be a right triangle but provides a preferred shape. End 37 of strapping 34 also passes through slot 39 in portion 27 of base 26. It is then bent at roughly a right angle, as shown in FIG. 2, and bolted against backer plate 26 as shown best in FIG. 3 of the drawings.

A pair of tension buckles 40 hold the outer ends 41 of strap 34. The tension buckles 40 have an arm 42 with a pair of slots 43 and 44 and an outwardly extending portion 45. Outwardly extending portion 45 has a hole 46 through which a bolt 47 passes. The two opposing outwardly extending portions 45 are tightened together by tightening nut 48 on bolt 47.

The result is a water heater restraint which may be easily assembled and secured to a wall by a homeowner without special tools. It also is capable of being packaged in a relatively small rectangular box, since all the parts may be readily disassembled into such a shape. Because the strapping is affixed to the tension buckles by passing the strap through the slots in the buckles and folding it back on itself, water heaters of different sizes can be accommodated by bending the strap near the outer end at a position appropriate for the particular size of water heater being secured. As is shown best in FIG. 4 of the drawings the strapping can be seen to securely surround the water heater and also be secured to the bi-channel strut 15.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A water heater restraint for securing a vertical cylindrical water heater adjacent a wall, which wall is supported by a plurality of vertical studs, said restraint comprising:

a bi-channel strut comprising an elongated member having an elongated back portion with a top edge and a bottom edge and having a pair of first channels adjacent said top and bottom edges and a pair of outwardly extending portions adjacent the pair of first channels, said outwardly extending portions each having an outer edge and a pair of second channels formed adjacent the outer edges of said pair of outwardly extending portions, each of said second channels having an inwardly directed elongated flange;

means for securing said hi-channel strut to the studs of a wall;

a pair of triangular gussets each having a base, an inner edge and an outer edge and each gusset being slidably positionable along said pair of second channels and when placed in a desired position with inner edges, each inner edge forming an inner support face which is angled outwardly away from the strut and away from each other, said inner edges facing inwardly having means for securement at the base thereof to said pair of second channels and each of said triangular gussets is formed from an elongated rectangular sheet of metal and the base of each gusset has two overlapping ends of the sheet and the overlapping ends have a hole therein through which a bolt may be passed and said gussets each being held to the second channel by a backer plate held against the inwardly directed elongated flange of the second channel and bolted to the base thereof; and strapping means for surrounding a water heater and means for securing said strapping means to said pair of triangular gussets and against said elongated strut and wherein said strapping means is a pair of lengths of strapping and each length having an inner end and an outer end and each inner end has a hole therethrough and is secured to the respective bases of the gussets by passing a gusset bolt therethrough and positioning each of the respective inner ends between the base of the gusset and the respective backer plates and wherein each of the inner ends of the two lengths of strapping is passed through a slot in the hypotenuse of each gusset and another slot in the base of each gusset whereby a water heater may be secured to a wall by affixing the bi-channel strut to the wall against which the water heater is to be affixed, sliding the gussets to the outer edges of the water heater and placing the strapping means around the water heater and securing the strapping means to the gussets and the gussets to the bi-channel strut.

* * * * *